United States Patent [19]

Simpson

[11] Patent Number: 4,791,756

[45] Date of Patent: Dec. 20, 1988

[54] LATCH FOR PIVOTAL SASH WINDOW

[75] Inventor: Harold Simpson, Hazel Crest, Ill.

[73] Assignee: Ashland Products Company, Chicago, Ill.

[21] Appl. No.: 166,669

[22] Filed: Mar. 11, 1988

[51] Int. Cl.[4] ..... E05D 15/22

[52] U.S. Cl. ..... 49/175; 49/449

[58] Field of Search ..... 49/174, 175, 176, 449, 49/450, 451, 161, 162, 180, 181, 184, 185, 394

[56] References Cited

U.S. PATENT DOCUMENTS

| | | | |
|---|---|---|---|
| 2,768,852 | 10/1956 | Hicks | 49/450 |
| 3,425,164 | 2/1969 | Storlie et al. | 49/450 |
| 4,475,311 | 10/1984 | Gibson | 49/176 |
| 4,553,353 | 11/1985 | Simpson | 49/175 |
| 4,578,903 | 4/1986 | Simpson | 49/175 |
| 4,622,778 | 11/1986 | Simpson | 49/175 |

*Primary Examiner*—Kenneth J. Dorner
*Assistant Examiner*—Gerald A. Anderson
*Attorney, Agent, or Firm*—Silverman, Cass, Singer & Winburn, Ltd.

[57] ABSTRACT

A latch for a pivotal window sash used in a double-hung window assembly. The latch is mounted internally in a sash frame member with its latch bolt protruding from the sash to engage in the guide rail of the main frame jamb of the window assembly. There is a finger manipulative control button external of the sash frame for releasing the bolt from said guide rail so that the window sash can be pivoted. The latch bolt is mounted under spring tension to maintain the bolt normally in a locked position. The several latch parts including the spring are maintained together in assembly as a unit to thereafter be installed in said window sash.

4 Claims, 1 Drawing Sheet

FIG. 1
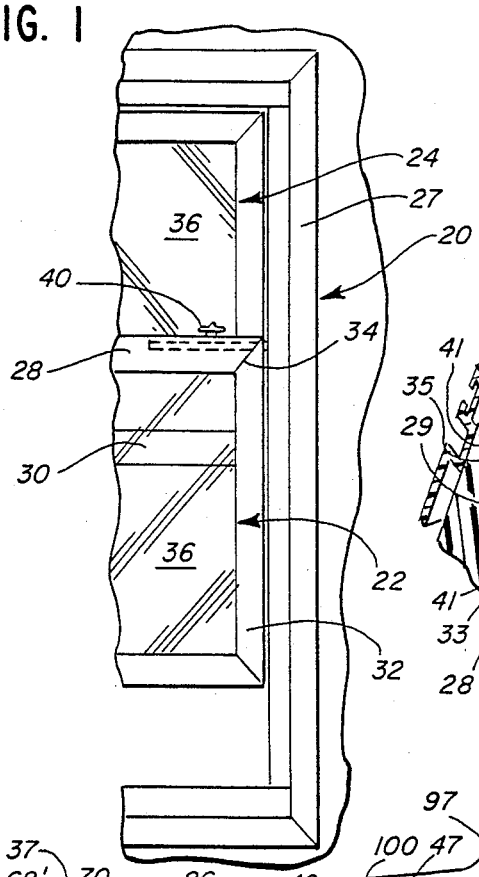
FIG. 2
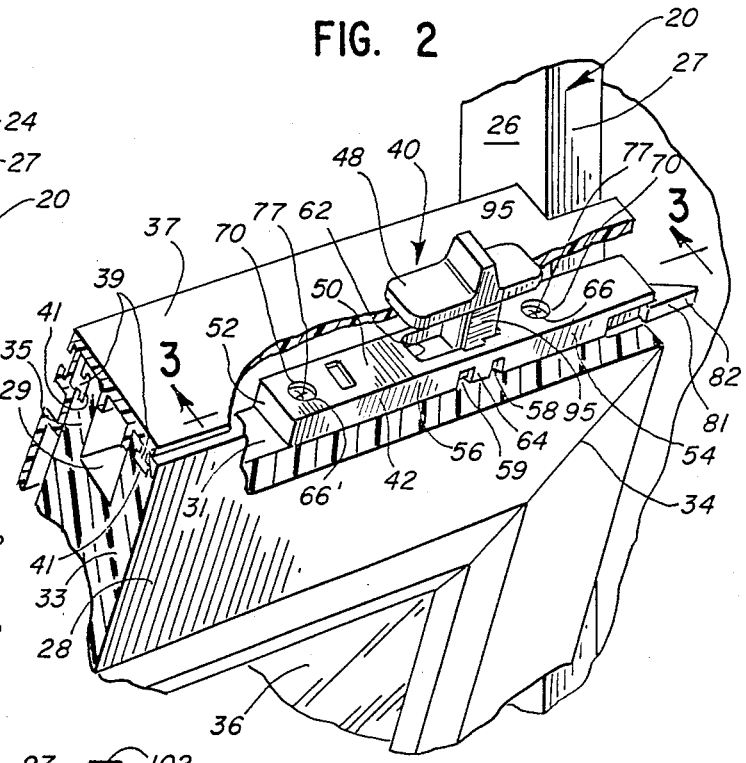
FIG. 3
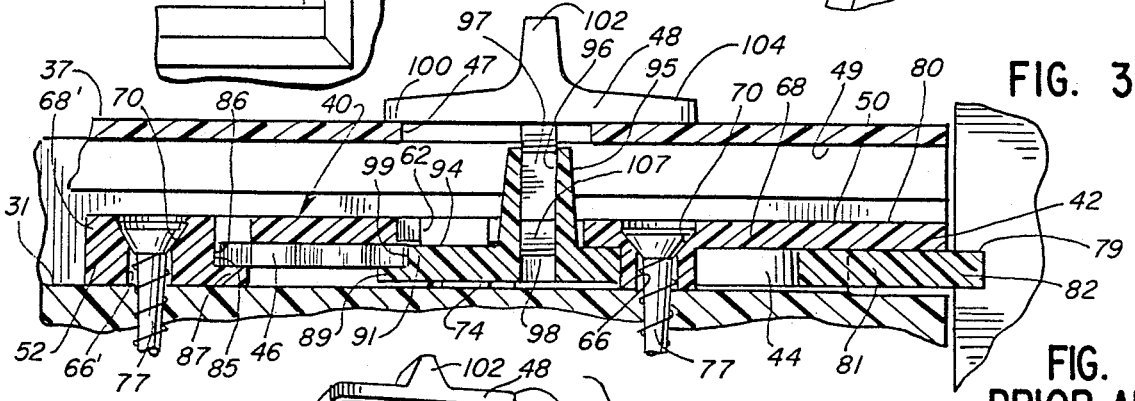
FIG. 5
PRIOR ART
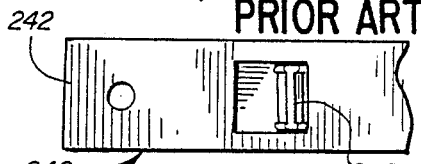
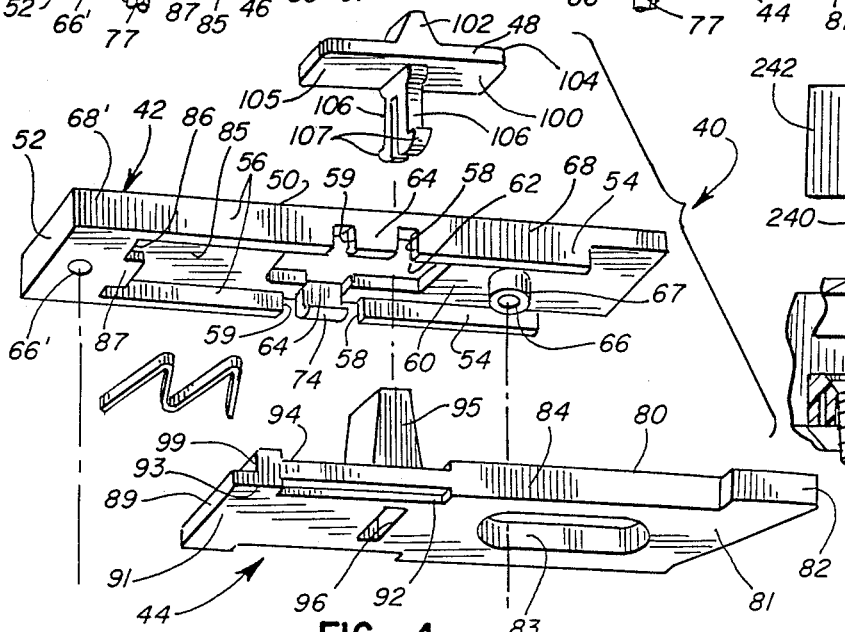
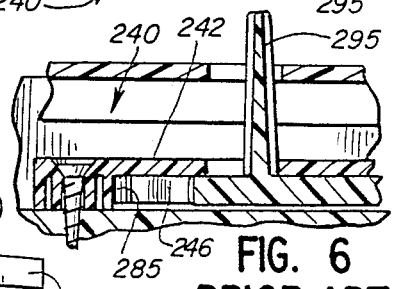
FIG. 6
PRIOR ART
FIG. 4

LATCH FOR PIVOTAL SASH WINDOW

RELATED CASE REFERENCE

This application is related to the subject matter of the latch of applicant's U.S. Pat. No. 4,553,353 entitled "Latch for Pivotal Sash Window" issued Nov. 19, 1985 and owned by the same assignee.

BACKGROUND OF THE INVENTION

This invention relates generally to a manually operative latch for a window sash of a double-hung window assembly and more particularly, to a novel spring-loaded multipart latch capable of being installed as a unit in assembled condition internally in the sash window frame and which is releasable from externally of the window frame. Further, this latch is particularly suitable for a pivotal sash window.

Double-hung window assemblies include a window frame and a pair of window sashes reciprocal vertically in guide rails of the master frame jamb of the window assembly. Such a window sash also can be pivotally mounted in the window frame. Normal vertical movement of the window sash is maintained by latch mechanisms located at opposed miterjoined corners of the window sash. Such latch mechanisms include a latch bolt which can slide along the guide rails but which, while engaged in the guide rails, prevents pivoting of the window sash. The window sash is pivotal within its window frame when the latch bolt is retracted from the guide rail by movement of a manual manipulative control button which is positioned exterior of the sash frame.

The latch mechanism of the invention herein can be mounted internally of a pivotal window sash formed of either synthetic plastic or metal sash frame members. Yet, it is hidden from view other than for the exposed control button for retracting the latch bolt thereof from a guide rail so that the sash can b pivoted. The latch of the invention is formed of multiple components which can be assembled and retained together as a unit independently of the window sash in which it is intended to be installed. Thus, the latch can be stored and shipped as an assembled unit to the window manufacturer for installation upon assembly of the sash window. The latch is economical to manufacture and easy to install and operate. Also, it is sturdy and capable of extended use without failure.

SUMMARY OF THE INVENTION

The invention comprises a latch mechanism for the pivotal window sash of a double-hung window assembly. Each sash comprises a rectangular frame formed by a top header, two side stiles and a bottom header. The top header includes a U-shaped channel formation extending the elongate length thereof with a base wall and upstanding side walls opening to the top of the header. A top plate is removably positioned upon the header to close off the open channel formation. The sash frame mounts suitable glazing. The headers and stiles are joined at contiguous miter joints, although miter forming can be replaced by square joints also. The stiles have outer side walls through each of which is provided a passageway opening outwardly of the sash frame.

The latch mechanism is mounted internally of the header by positioning within the channel formation to rest on the base wall thereof. The latch mechanism includes a spring mounted latch bolt having a tapered extremity protruding through a said passageway to engage the guide rail of the master frame jamb of the window assembly. The latch bolt is linearly movable within the housing for retracting from the guide rails by means of a manually manipulative control member positioned exterior of the header top plate. The latch bolt normally is spring-biased to a locking position engaged in the guide rail.

The operating parts of the latch are formed of molded plastic materials, with the exception of the spring utilized. The spring is positioned in a pocket of the housing to abut a wall of said pocket and an oppositely disposed surface of said latch bolt. The spring is retained in said pocket by respective overhange flanges formed adjacent said wall of the pocket and on the said surface of the latch bolt such that the several latch parts including the spring may be assembled and maintained together as a unit to thereafter be stored and shipped as an assembled unit ready to be installed in said window sash by the window manufacturer.

BRIEF DESCRIPTION OF THE DRAWING

FIG. 1 is a fragmentary front elevational view of a double-hung window assembly having the latch mechanism embodying the invention installed on the window sash of the assembly;

FIG. 2 is a fragmentary perspective view of a window sash in a pivotal open position and partially broken away to show details of said latch mechanism;

FIG. 3 is a sectional view taken along the line 3—3 of FIG. 2 in the direction indicated generally;

FIG. 4 is an exploded perspective view of the latch assembly embodying the invention;

FIG. 5 is a top plan view of a prior art latch mechanism shown on a reduced scale; and FIG. 6 is a fragmentary sectional elevational view showing details of said prior art latch mechanism installed in a window sash.

DESCRIPTION OF PREFERRED EMBODIMENT

FIG. 1 illustrates partially a representative window of the so-called double-hung window sash assembly. Such an assembly includes a main jamb frame 20 within which is slidably mounted a pair of double hung sashes 22 and 24 fitted with suitable glazing. Both the frame 20 and sashes 22 and 24 can be formed of several different materials, such as metal or strong and rigid plastic materials well known in this field. For purposes of this invention, the sashes 22 and 24 are pivotal relative to the frame 20 to permit cleaning and other required maintenance thereof.

The main frame 20 and the sashes 22 and 24 perferably are fabricated from elongate framing members of hollow configuration in transverse cross-section for well known reasons of weight economy and thermal insulation advantages. The exact construction of main frame 20 is not critical for achieving the advantages of this invention. The vertical structural members of the main frame 20 will mount sash balances (not shown) which will cooperate with pivot pins (not shown) installed on the sashes 22 and 24 to permit desired pivotal movement of the sashes relative to the main frame. Further, these vertical structural members of the frame 20 will present guide rails facing toward a contiguous sash with which the latch mechanism embodying the invention operates. A typical guide rail is designated 26 in FIG. 2 for the purpose of describing this invention.

The guide rail 26 would be formed in a side jamb 27 of the main jamb frame.

Referring to FIGS. 1 and 2, the sash 22 is generally rectilinear in configuration and is comprised of a top header 28, a base header 30 and a pair of side members or stiles, one of which is illustrated at 32. The stiles or side members 32 are miter-jointed at their extremities to continuous extremities of the header and base members, as seen at 34, to provide the sash frame of desired size and configuration. The miter-jointed corners of the sash are maintained by suitable fasteners and brackets of well-known, commercially available types. Top header 28 includes a U-shaped channel formation 29 extending along the elongate length thereof with a base wall 31 and upstanding side walls 33, 35 opening to the top of header 28. A top plate 37 is removably positioned upon header 28 by mating tongue and groove members 39, 41, for example, to close off the open channel formation 29. It will be appreciated that the upper sash 24 will be of like or similar construction. The glazing 36 is conventionally installed in a sash frame.

The latch mechanism embodying the invention is designated generally by reference character 40. The component parts of latch 40 are seen in FIG. 4 to include a housing 42, a latch bolt 44, a generally W-shaped leaf spring 46 and a control member or finger button 48. The housing 42, bolt 44 and button 48 are plastic molded members of suitably strong synthetic resin material, such as polystyrene, for example. The mechanism 40 is seen installed internally in sash 22 in FIG. 2 with only the control member 48 exposed for manually operating the latch mechanism.

Housing 42 has a flat upper surface 50 provided on the plate-like formation 52 which extends the full length of the housing. Depending along opposite longitudinal edges of the plate formation 52 is a pair of side walls 54 and a pair of side walls 56 separated by spaces 58, 59, between which are formed opposite side walls 64. The side walls 54 and 56 define a chamber 60 therebetween opening downwardly from formation 52 along the length of the housing. The top wall 50 has an elongated, rectangular slot 62 opening downwardly into chamber 60 between side walls 64. The formation 52 has a pair of passageways 66, 66', one at each end 68, 68' thereof. Passageway 66 is formed in a depending cylindrical boss 67. Each passageway 66, 66' has a countersunk bore 70 therein extending below the upper surface 50. Each side wall 64 has an inwardly extending flange 74 at its lower extremity so that the flanges 74 are facing toward each other to provide a ledge to retain latch bolt 44 within housing 42 as explained hereinafter.

The latch bolt 44 is an integral, one-piece member. The upper surface 80 of bolt 44 is generally planar and provided with a through-slot 83 opening from the surface 80. There is an enlarged end 81 provided with an outer free extremity 82 which is canted or angled. Extending inwardly from end 81 is an elongate, medial body segment 84. Segment 84 is provided with ovate the slot 83 extending therethrough. The opposite end 94 of bolt 44 has an upstanding rigid post 95 formed thereon with a passageway 96 passing entirely therethrough. The interior walls of post 95 are chamfered, as seen at 97 in FIG. 3, and are undercut, as seen at 98. The opposing lower edge surfaces 93 of end 94 are provided with undercuts 92.

Referring to FIGS. 2, 3 and 4 for installation and operation of the latch mechanism 40. The generally W-shaped leaf spring 46, of suitable dimension, is installed in pocket 85 of housing 42 resting against wall 86 proximate the rear end 68' thereof and in compressed condition. One end of the leaf spring 46 abuts wall 86, as seen in FIG. 3. The other end of the leaf spring abuts the rear wall surface 99 of bolt 44 when it is assembled in housing 42. Flange 87 is formed on the undersurface of housing 42 extending beyond wall 86, and flange 89 is formed on the rear end 91 of bolt 44 extending beyond wall 94 and facing flange 87. Leaf spring 46 is retained in pocket 85 by said respective facing flanges 87, 89 which prevent the spring from falling out of said pocket when the bolt is assembled in the housing.

Bolt 44 is assembled in housing 42 by snap fitting end 94 past the walls 64 which are sufficiently flexible for this purpose. The flanges 74 will engage against the undercuts 92 of the edge surfaces 93 of bolt 44 to retain the bolt installed. The flat, smooth surface 80 will be contiguous with the undersurface of plate formation 50. The cylindrical boss 67 is received in the ovate slot 83. Upstanding post 95 extends through slot 62 and projects above same. The end 94, which is of the same width as the medial body segment 84, is received loosely between the side walls 54 and 64. Likewise, the medial segment 84 is loosely received between side walls 56 so that the bolt 44 can be slid relative the housing 42. Both the undersurface of plate 52 and the contiguous upper surface 80 of bolt 44 are smooth so as to reduce friction therebetween when the bolt 44 is slid relative to the housing 42 in operation of mechanism 40. Also, the end 81 protrudes outwardly of the end of the housing 42 in assembly mode.

The thus assembled housing 42 and bolt 44 are maintained together as a unit for installation in a window sash frame. The assembly is installed internally of sash 22 at each upper, miter-joined corner thereof. The base wall 31 of channel formation 29 in header 28 has a pair of openings spaced apart to align with the passageways 66 and 66' at an upper corner of the sash 22. Suitable threaded fasteners 77 are engaged in the aligned openings and passageways to secure housing 42 against the base wall 31 of the header 28. The end 81 of bolt 44 is extended through an aligned opening 79 in the side member or stile 32 so that the canted edge 82 can be engaged with the guide rail 26 of the side frame jamb 27. After mounting of assembled housing 42 and bolt 44 on base wall 31, top plate 37 is positioned upon header 28 by sliding tongues 39 in grooves 41, to close off the top of open channel formation 29. Thus, the assembled housing and latch bolt are installed internally in the sash 22, one at each upper corner thereof.

The control member or button 48 is an integral member having a plate part 100 carrying a finger button formation 102 on its upper surface 104. The formation 102 can assume any one of many different configurations so long as it provides an enlarged finger grip as represented at 102. Depending from the bottom surface 105 is a pair of spaced apart posts 106. Each post has a flange 107 at its free end extending outwardly from the flange. The posts 106 are spaced apart a selected distance so that they may be snapfitted into the passageway 96 of post 95 by compressing the posts slightly to enable the flanges 107 to extend beyond the chamfered walls 97 and engage the undercuts 98, as seen in FIG. 3. Of course, it will be understood that the header top plate 37 of 28 is provided with a suitable slot 47 to align with slot 62 for accommodating the post 95 therethrough. Further, the length of the post 95 is selected to accommodate the distance between base wall 31 upon which latch mechanism 40 is mounted and the undersurface 49 of top plate 37. Post 95 is of rigid, stocky generally rectangular cross-sectional configuration so as to resist bending and breaking as the latch is activated by moving said post.

In the normal installed position of the latch mechanism, the sash 22 will be closed as explained in U.S. Pat. No. 4,553,353. Spring 46 is mounted in a compressed condition so as to urge bolt 44 into engagement with the guide rail 26 and prevent pivoting of the window. To open the latch 40, the finger button 102 is moved in a direction away from the guide rail 26. The post 95 will move the latch bolt 42 to retract the end 81 and withdraw the angled edge 82 from the guide rail sufficiently so that window sash 22 can be pivoted open, as seen in FIG. 2. Of course, the latch mechanism 40 at each upper corner of the sash 22 must be so manipulated to open sash 22. Upon release of the button 102, the latch bolt will be urged outwardly to its normal protruding position depicted in FIGS. 2 and 3.

The latch 40 of the invention is an improvement over prior art latches, such as latch 240 shown in FIGS. 5 and 6. The housing 242 of latch 240 includes a pocket 285 which is devoid of any structure to retain W-shaped leaf spring 246 therein. Thus, the several parts of latch 240 are not maintained together as a unit when assembled because spring 246 may fall out of pocket 285 prior to the latch being positioned on header 28 to close off the space below pocket 285 in which spring 246 is retained. The flanges 87, 89 formed adjacent pocket 85 of latch 40 of the invention achieve the necessary function of retaining the spring in the pocket so that the latch can be retained in assembly as a unit. Further, post 95 is an improvement over prior art post 295 because the latter is slender and weak and therefore, subject to breakage when a force is exerted thereon to operate the latch.

Modifications and variations of the present invention are possible in light of the above teachings. It is therefore to be understood that within the scope of the appended claims, the invention may be practiced otherwise than as specifically described.

I claim:

1. In a pivotal-type window sash installed in the main jamb frame of a double-hung window assembly having opposed, vertically extending guide rails to enable vertical reciprocal sliding movement of the sash in the main jamb frame while cooperatively engaged with the guide rails, the sash having a header, a base and a pair of stiles cooperatively connected together at adjacent extremities thereof to form a miter-jointed, rectangular sash frame; a latch mechanism operatively installed internally of the sash frame to said header, said latch mechanism manually operable from externally of the sash frame for releasing the latch mechanism to permit pivotal movement of the window sash, said latch mechanism comprising:

A. a housing having a planar upper wall with a slot opening therein, passageways provided at opposite ends of said wall opening to the upper surface thereof, and opposing side wall formations depending from said planar wall along opposite longitudinal edges of the planar wall, a pair of said side wall formations having flange formations at the extremities thereof;

B. a latch bolt slidably installed in said housing between said side wall formations supported on said flange formations below said planar wall, said bolt having an end segment protuding beyond an end of said housing for engaging in a guide rail for releasably locking the said frame against pivotal movement relative to the master jamb frame, the bolt being installed under spring tension normally urging said end segment into locking position relative to a guide rail;

C. a rigid post formed on the latch bolt and extending through the slot in said planar wall for manually sliding the bolt against said spring tension for retracting said end segment from a guide rail;

D. said housing secured to an interior surface of said header by fastener means extending through the header into said passageways and said end segment of the latch bolt extending through an opening in a stile into operative engagement with a guide rail;

E. a pocket formed beneath said upper wall and defined by a rear wall of said housing and a surface of said latch bolt opposite said protruding end segment, respective oppositely-facing flanges disposed on said rear wall and said latch bolt surface to at least partially close-off said pocket, and a spring positioned and retained in said pocket by said flanges.

2. The latch mechanism of claim 1 in which said housing, latch bolt and spring are assembled and maintained together as a independent unit to be secured in said header.

3. The latch mechanism of claim 1 in which said post has a passageway passing entirely therethrough with a chamfered undercut surface therein, and a control member installed upon said post with depending flanged members in said passageway and engaging said undercut surface to retain the control member on said post.

4. The latch mechanism of claim 3 in which said post is of generally rectangular cross-sectional configuration.

* * * * *